US011447359B1

(12) United States Patent
Herrmann et al.

(10) Patent No.: US 11,447,359 B1
(45) Date of Patent: Sep. 20, 2022

(54) HIGH SPEED ADHESIVE COLLATION SYSTEM FOR RETAIL SIGNAGE

(71) Applicants: Douglas K Herrmann, Webster, NY (US); Hans Franklin Case, Jordan, MN (US)

(72) Inventors: Douglas K Herrmann, Webster, NY (US); Hans Franklin Case, Jordan, MN (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 17/388,480

(22) Filed: Jul. 29, 2021

(51) Int. Cl.
*B65H 39/10* (2006.01)
*B65H 37/04* (2006.01)
*B65H 43/00* (2006.01)

(52) U.S. Cl.
CPC ..... *B65H 37/04* (2013.01); *B65H 39/10* (2013.01); *B65H 43/00* (2013.01)

(58) Field of Classification Search
None
See application file for complete search history.

(56) References Cited

U.S. PATENT DOCUMENTS

| | | | | |
|---|---|---|---|---|
| 4,863,154 | A * | 9/1989 | Hirakawa | B65H 43/00 198/460.3 |
| 5,039,082 | A * | 8/1991 | Littleton | B65H 29/68 271/182 |
| 5,950,510 | A * | 9/1999 | Scheffer | B65H 35/08 83/88 |
| 6,023,034 | A * | 2/2000 | Nakajima | B65H 39/10 198/460.3 |
| 6,350,333 | B1 * | 2/2002 | Welch | B65H 35/0006 156/64 |
| 6,644,644 | B2 * | 11/2003 | Vedoy | B65H 31/3081 271/3.03 |
| 9,463,945 | B2 * | 10/2016 | Herrmann | B65H 31/3009 |
| 9,463,946 | B2 | 10/2016 | Herrmann | |
| 9,527,693 | B2 * | 12/2016 | Herrmann | B65H 31/34 |
| 9,624,062 | B1 * | 4/2017 | Herrmann | B65H 31/34 |
| 9,668,621 | B2 * | 6/2017 | Andersson | B32B 3/06 |
| 10,071,877 | B2 | 9/2018 | Herrmann et al. | |
| 10,968,068 | B1 * | 4/2021 | Herrmann | B65H 31/3081 |

* cited by examiner

*Primary Examiner* — Leslie A Nicholson, III
(74) *Attorney, Agent, or Firm* — William A. Henry, II

(57) ABSTRACT

Signage packs for retail store shelves are compiled with a continuous belt pusher system having multiple pushers that allow accumulated set signage packs to be collated and pushed to a downstream transport system that forwards them for the application of hot-melt adhesive to an edge of each pack while simultaneously eliminating printer skipped pitches.

20 Claims, 4 Drawing Sheets

HIGH SPEED ADHESIVE COLLATION SYSTEM FOR RETAIL SIGNAGE

BACKGROUND

1. Field of the Disclosure

The presently disclosed embodiments are directed to providing an auto-collation system, and more particularly, to a collation system having a belt pusher system that moves collated sets downstream to an adhesive dispensing station.

2. Description of Related Art

Retail stores often utilize signage to convey information regarding products offered for sale, for example, product cost, unit cost, sale pricing, etc. Such signage must be updated and/or replaced on a periodic basis. For example, regular product pricing may change, or during a sale, a discounted price may be necessary. Changes to signage may be required for hundreds or even thousands of products and these changes may be required daily, weekly or another periodic term. In some states, it is critical that the signage be updated in a timely fashion as the retail store may be obligated to honor the price displayed adjacent the product. In other words, if the store fails to remove signage that displays a discounted cost, the store must charge that cost if a customer relies upon that price when making a purchase selection. In view of the foregoing, it should be apparent that proper timing and placement of signage is a critical responsibility of a retail store.

Although some retail chain stores share common store layouts, also known as a store planogram, most retail locations, even within a chain store, have unique store planograms. The changeover of signage can incur significant time which in turn incurs significant cost. A common practice is to print sheets of signage and an employee or group of employees are tasked with signage changeover. These methods include various deficiencies, for example, sheets printed out of order or not matched to the store planogram, sheets that require further separation of individual signage labels, etc.

In view of the foregoing issues, some stores require signage to be in a per store planogram order and to be pre-separated, both to facilitate the efficient changeover of signage. It has been found that to achieve this arrangement of signage, signage labels or cards are imposed so that each set of labels is in sequential order within a sheet and then across the collection of sheets. Cards may be delivered to various stores in different sized stacks. For example, a stack of ninety-six cards would require eight sheets, each sheet containing twelve labels, to be collated sequentially to produce a complete stack. Cards of this type may be cut using a high speed cutting system. The cards may be fed from a slitter system into bins, however it has been found that these systems are ineffective as the cards are not guided and adjacent cards interfere with each other as they bounce and settle into the bins. Such systems cause a high percentage of media jams and thus result is downtime and increased costs.

The heretofore mentioned problems were addressed in U.S. Pat. No. 9,463,946 which is incorporated herein by reference to the extent needed to practice the present disclosure and provides a system for collating a plurality of media including a first bin, a second bin arranged adjacent to the first bin, a collated stack receiver arranged proximate the second bin opposite the first bin, first, second and third guides, where the first and second guides are positioned on opposing sides of the first bin, and the second and third guides are positioned on opposing sides of the second bin, and a pusher. When the first, second and third guides are positioned in non-retracted locations, a first set of the plurality of media is deposited in the first bin and a second set of the plurality of media is deposited in the second bin, and when the first, second and third guides are positioned in retracted locations, the pusher moves the first set to the second bin vertically above the second set to form a first combined set and then moves the first combined set to a collated stack receiver.

This system employs a set of static angled collation bins and a one-direction pusher that directs media into a single bander. After each push the collation system resets by dynamically dropping the pusher and rewinding the pusher under the bins and then actuating the pusher into an up position to home to prepare for the next collation. Because the system must reset to the home position after each push, significant time is added to the overall process and system timing is negatively affected. In addition, the drop and reset to height causes additional vibration and settling issues and an attempt was made to address this issue is in U.S. Pat. No. 10,071,877 included herein by reference. System timing is also affected because the original imposition for 26" sheets (32 cards/sheet), allowed the complete push operation to be accomplished with one skipped pitch. However, with a current aisle sort requirement (each aisle's cards are to be banded) the 32" up and 26" sheet is no longer valid. The smallest aisle stack is only 12 cards and the average is 24 cards. This is accomplished with sheets that are <13". This makes the pitch timing very short due to the small set sizes. Based on that the number of skipped pitches for the average sets is approximately 3 to 4 skipped pitches for every 5 pitches for small aisle sets. This significantly reduces the productivity of each of the systems. In addition, once the banded sign stacks are brought to each aisle of a store for application they are unbanded and adhered to store shelving. This is difficult and the signs are often dropped and scattered where an applier must pick them up reorder them and continue to apply them to shelves.

The present disclosure addresses all of these problems in a practical and cost effective system and method.

BRIEF SUMMARY

Accordingly, an adhesive retail signage pack is disclosed that is based on aisles where an adhesive is applied along an edge of a stack to make a solid pack that allows for the sign applier at the store to remove one sign at a time from the pack. The store sign appliers are able to hold the pack with one hand while peeling each successive sign from the top of the pack. The retail signage packs are compiled with a continuous belt pusher system with multiple pushers that allow the accumulated sets to be collated and pushed to a downstream transport system that forwards them for the application of hot-melt adhesive to a side edge of the pack while simultaneously eliminating skipped pitches.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

At the outset, it should be appreciated that like drawing numbers on different drawing views identify identical, or functionally similar, structural elements of the embodiments set forth herein. Furthermore, it is understood that these embodiments are not limited to the particular methodology, materials and modifications described and as such may, of course, vary. It is also understood that the terminology used herein is for the purpose of describing particular aspects only, and is not intended to limit the scope of the disclosed embodiments, which are limited only by the appended claims.

Moreover, although any methods, devices or materials similar or equivalent to those described herein can be used in the practice or testing of these embodiments, some embodiments of methods, devices, and materials are now described.

Figure 1:
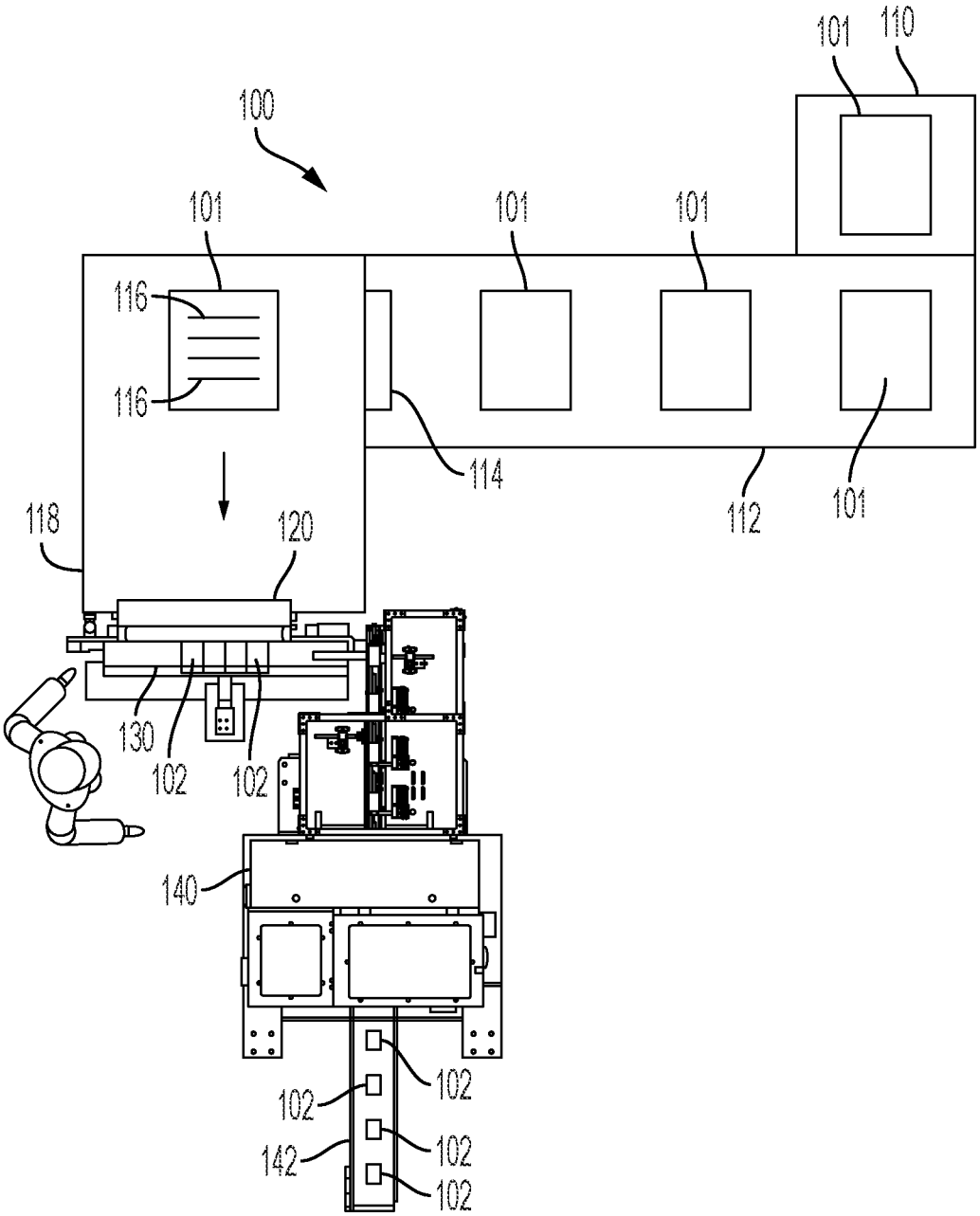
FIG. 1 PRIOR ART
FIG. 1 is a plan view of a prior art signage collation system that includes a bander.

Prior art FIG. 1 shows a collation system 100 in which card sheets 101 are directed into multiple bins and pushed out of the bins into a bander. Card sheets 101 are outputted from a printer 110 onto a conveyor 112 positioned lengthwise and forwarded into a slitter 114 that is movable between cutting and non-cutting positions. In the cutting position slitter 114 places slits 116 across a portion of card sheets 101 and conveyor 118 conveys the sheets into a second cutter 120 which then cuts the card sheets into individual cards and forwards them into a collection station 130 that includes four bins 132, 134, 136 and 138 shown in detail in FIG. 4. The cards are pushed in sets 102 from the bins into a bander 140. Card sets 102 are outputted from bander 140 onto conveyor 142 for pickup by an operator.

Figure 2:
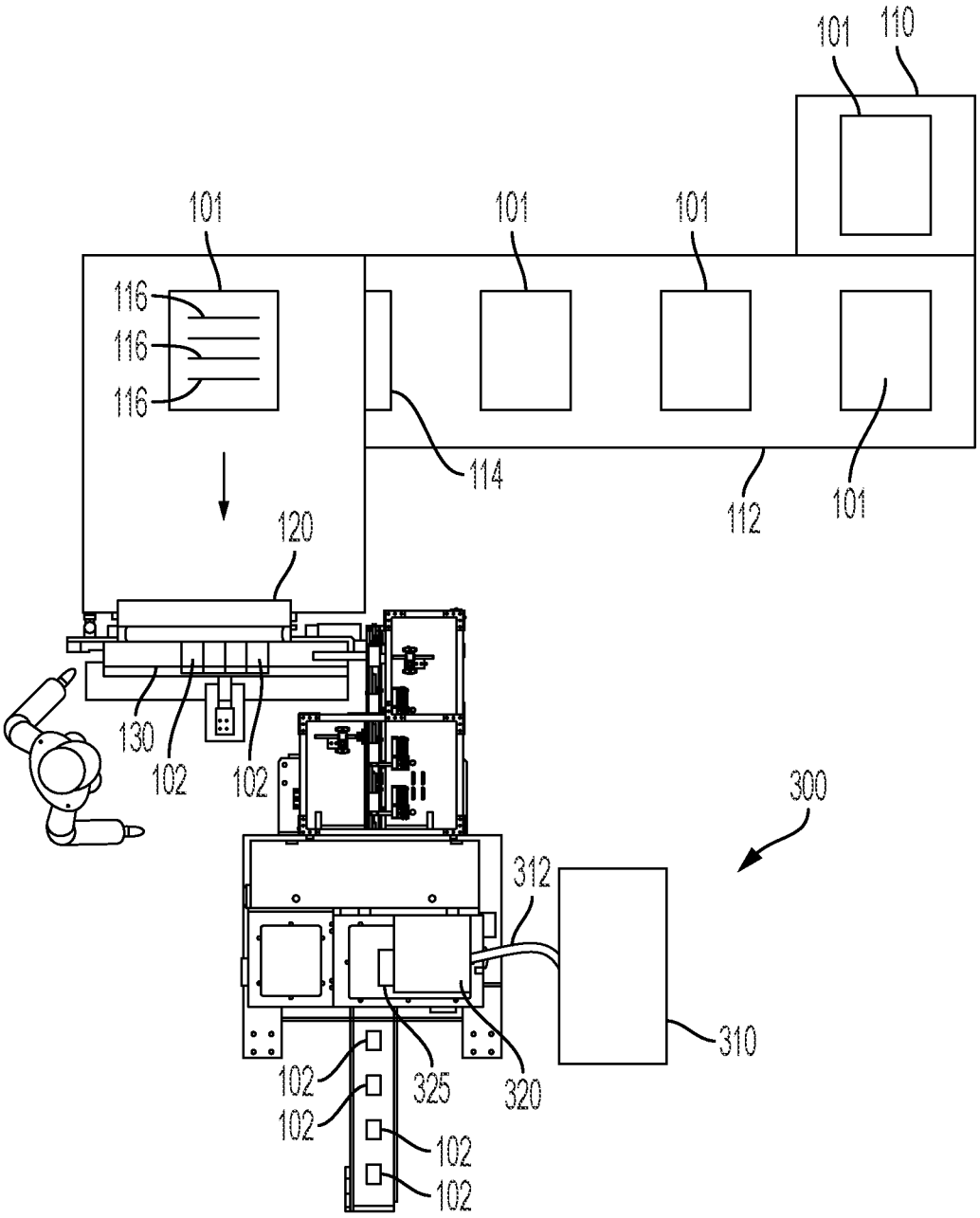
FIG. 2 is a plan view of an adhesive collation system for retail signage in a 90° configuration in accordance with the present disclosure.
Figure 3:
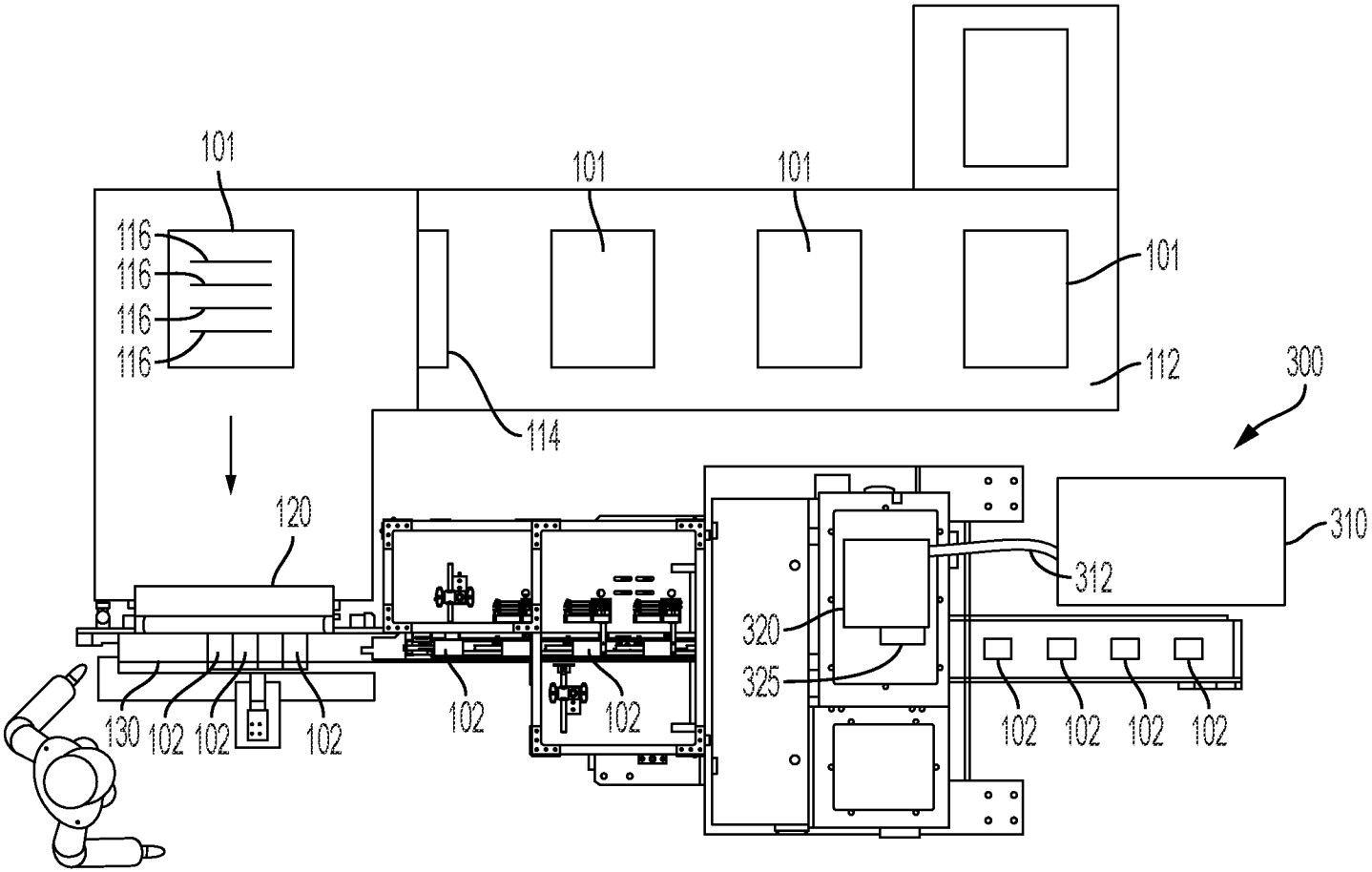
FIG. 3 is a plan view of an adhesive collation system for retail signage in an in-line configuration in accordance with the present disclosure.

In FIGS. 2 and 3, and in accordance with the present disclosure, an improved collation system for retail signage is shown that provides adhesive based aisle stacks that eliminate the need for banding signage and simultaneously improves instore signage placement performance and print/finishing efficiencies at a print facility. The improved collation system replaces the one-direction push and reset motion currently used with a system belt and pusher that moves collated sets to a downstream secondary pusher system that then delivers the accumulated stacks to a drive system and a variable hot-melt adhesive station. The secondary pusher system changes the stack to stack distance which reduces the forward motion of the stacks allowing for the stacks to increment past an adjustable width/height adhesive station. The adjustable width/height adhesive station is then adjusted to match the stack signage count/height and the system then dispenses a measured thin layer of hot-melt adhesive along an edge of each stack to create an adhesive stack based on predicted stack size. Afterwards the stacks are transported downstream for curing/drying of the adhesive. The stacks are then packed and sent to stores where operators can walk the aisles peeling one card off a stack at a time and adhere the card to shelf edge strips. No longer needing to hold unbundled signs.

A 90° pusher belt collation system, configured in accordance with the present disclosure, is shown in FIG. 2 while an in-line pusher belt collation system is shown in FIG. 3 with each including a variable adhesive sign stack application. Cards 102 entering angled accumulator 130 of FIG. 2 or 3 are counted for each collation for later use in adjusting the height of hot-melt adhesive head 325. A continuous belt pusher system 200 in FIG. 4 includes belt 202 with multiple pushers 204 that facilitate the accumulated sets 102 in bins of angled accumulator 130 to be collated and pushed to a downstream secondary conveyor 210. As an active pusher 204 is moving a stack of cards, the next pusher 204 on the belt is reset to the push position ready for the next accumulation of cards in the angled accumulator. The downstream secondary conveyor 210 slows the stack motion by collapsing the push distance and thus reducing the inter-stack spacing. The card stacks 102 are then conveyed past the automated variable side adhesive/hot-melt station that applies an adhesive along the card stack edge based on stack height. This height can be determined by the number of signs in the card stack and the card thickness. An adhesive patch is adjusted to match the height of each card stack and the timing is set to apply the adhesive to the prescribed length and thickness. Adhesive application station 300 is where adhesive fill and heating station 310 sends hot-melt adhesive through an adhesive fill line into adhesive applicator 320 which in turn sends the hot-melt adhesive into variable adjusting adhesive heads 325 where hot-melt adhesive is applied to each adjacent card edge. Additionally, a secondary height sensor 330 at the secondary transport upstream of the adhesive station can be used to either identify and/or confirm the stack height for the adjustment of the variable adhesive station. Secondary height sensor 330 could be a reflective sensor from one side to the other or a through sensor from one side to the other. An increase in productivity of the collation system is realized by eliminating the recycling pusher, combining the primary belt push with a secondary card collection system and integrating a variable hot-melt system to optimally apply adhesive to a stable card stack.

Figure 4:
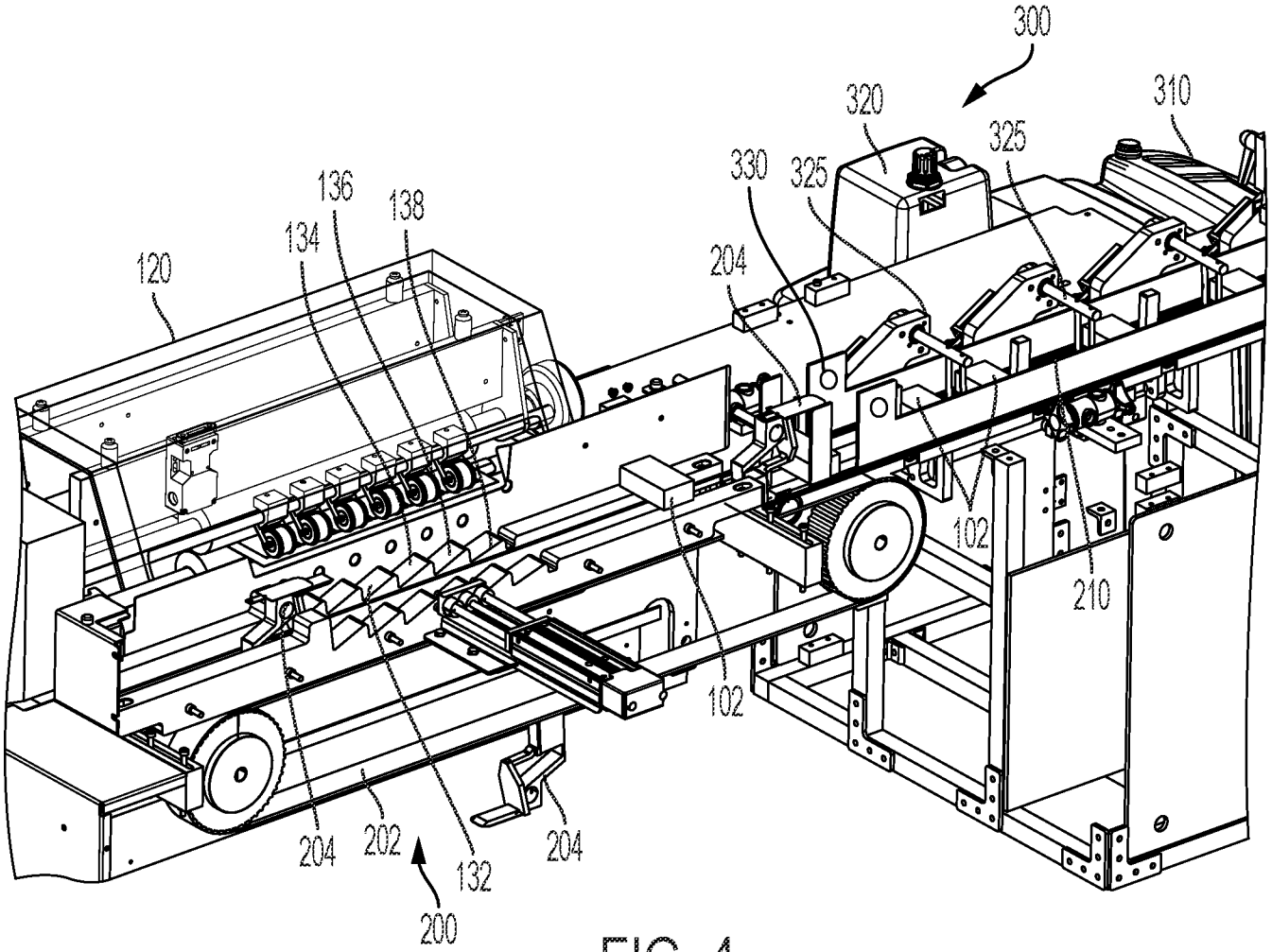
FIG. 4 is a partial perspective view of the adhesive collation system for retail signage of FIG. 3 in an in-line configuration showing angled accumulator bins being emptied by pushers.

In FIG. 4, bins 132, 134, 136 and 138 of angled accumulator 130 are shown. Individual and separate cards exiting slitter 120 enter each bin and drop into the separate bins. Bins 132, 134, 136 and 138 are each separated into two parts with a passageway in between the two separate parts. The passageway accommodates pushers 204 actuated after a counting of cards for each collation is completed and forwards card stacks from continuous belt 202 onto as secondary conveyor 210 which conveys the cards past hot-melt heads 325 for the application of adhesive to each card stack.

In recapitulation, the elimination of the return reset of current pusher systems is accomplished by introducing a continuous belt pusher system with multiple pushers connected thereto that allows accumulated sets of cards to be collated and pushed to a downstream transport system. As an active pusher is moving a card stack, the next pusher on the belt is reset to a push position ready for the next accumulation of cards in an angled accumulator. A downstream system slows the stack motion by collapsing the push distance and thus reduces the inter-stack spacing. The stacks are then transported past an automated variable side adhesive/hot-melt station that applies an adhesive along the stack edge based on stack height. This height is determined by the number of signs in the stack and the media thickness. An adhesive patch is adjusted to match the height of each stack and the timing is set to apply the adhesive to the prescribed length and thickness. Productivity of the collation system is increased by eliminating the recycling pusher, combining the primary belt push with a secondary collection system and integrating a variable hot-melt system to optimally apply adhesive for a stable stack.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for producing sets of adhesive backed retail signage, comprising:

providing a media collection station, said media collection station including a plurality of angled accumulator bins adapted to receive media in collated sets in each of said plurality of accumulator bins;

providing a first continuous conveyor adapted to advance said collated sets of media downstream, said first conveyor including attached pushers configured to contact said collated sets of media as said first conveyor is rotated and push said collated sets of media downstream;

configuring a second continuous conveyor to receive said collated sets of media from said first conveyor and change collated set to collated set distance between said collated sets of media as said collated said sets of media are conveyed downstream;

providing a series of variable adhesive dispensers, said variable adhesive dispensers being configured to dispense adhesive to an edge of each of said collated sets of media;

adjusting dispense of adhesive from said series of variable adhesive dispensers to match height and width of said collated sets of media; and moving said sets of collated media past said series of variable adhesive dispensers with said second conveyor.

2. The method of claim 1, including providing said first conveyor at least three pushers.

3. The method of claim 1, including transporting said sets of adhesive treated media downstream for curing of said adhesive.

4. The method of claim 3, wherein said second conveyor reduces forward motion of said collated sets of media received thereon from said first conveyor allowing for said collated sets of media to increment past said adhesive dispensers.

5. The method of claim 4, including measuring said height of said collated sets of media by the number of media in each of said collated media sets and the thickness of said each of said collated media sets.

6. The method of claim 5, including setting timing of dispense of said variable adhesive dispensers to apply said adhesive to predetermined length and thickness of said collated sets of media.

7. The method of claim 5, including providing a secondary height sensor to confirm said height measurement of said collated sets of media.

8. The method of claim 5, including providing said first conveyor as a continuous belt.

9. The method of claim 8, wherein as an active pusher is moving a set of said collated media sets, the next pusher on said continuous belt is reset to a push position ready for the next accumulation of collated sets of media in said angled accumulator.

10. A system for producing sets of adhesive backed retail signage, comprising:

a collection station having a plurality of bins adapted to receive said sets of retail signage in each of said plurality of bins, and wherein each of said plurality of bins is configured with a passageway therein;

a continuous belt positioned beneath said plurality of bins, said continuous belt including a plurality of pushers attached thereto spaced from each other around said continuous belt and adapted to traverse said passageways of said plurality of bins;

a conveyor positioned downstream of and in-line with said continuous belt and adapted to receive said sets of retail signage from said continuous belt, said conveyor being configured to slow the stack motion of said sets of retail signage to change the stack to stack distance and thereby reducing the inter-stack spacing of said sets of retail signage on said conveyor; and a plurality of variable adjusting adhesive heads configured to apply adhesive to an edge of each adjacent set of retail signage.

11. The system of claim 10, wherein each of said pushers is adapted to traverse said passageway while removing said sets of retail signage from each of said plurality of bins and forward them to said conveyor.

12. The system of claim 11, including a sensor downstream of said continuous belt for sensing the height of each set of retail signage.

13. The system of claim 12, wherein said plurality of variable adjusting adhesive heads applies an adhesive along said edge of said sets of retail signage based on set height.

14. The system of claim 13, wherein said height is determined by the number of retail signage in each set and retail signage thickness.

15. The system of claim 10, wherein said plurality of variable adjusting adhesive heads is adjusted to match the height of each of said sets of retail signage.

16. The system of claim 15, wherein said application of adhesive to said edge of each adjacent set of retail signage is adjusted according to the width of each set of said retail signage.

17. The system of claim 12, wherein the height of each of said sets of retail signage is determined by the number of retail signage in each set and signage thickness.

18. The system of claim 10, wherein moving said plurality of pushers through said passageway simultaneously moves said sets of retail signage out of said plurality of bins.

19. The system of claim 18, wherein each of said plurality of bins includes two parts with said passageway therebetween.

20. The system of claim 19, wherein said plurality of pushers include at least three pushers.

* * * * *